US005685430A

United States Patent [19]

Weisburn et al.

[11] Patent Number: 5,685,430

[45] Date of Patent: Nov. 11, 1997

[54] PHOTOGRAPH AND NEGATIVE STORAGE CONTAINER

[75] Inventors: James T. Weisburn, Massillon; Craig M. Saunders, Rocky River; Jeffrey M. Kalman, Cleveland Hts., all of Ohio

[73] Assignee: Alpha Enterprises, Inc., North Canton, Ohio

[21] Appl. No.: 674,540

[22] Filed: Jul. 2, 1996

Related U.S. Application Data

[63] Continuation-in-part of Ser. No. 264,964, Jun. 24, 1994, Pat. No. 5,558,225.

[51] Int. Cl.[6] ..... B65D 85/62

[52] U.S. Cl. ..... 206/455; 206/425; 206/578; 220/259; 220/505; 220/524

[58] Field of Search ..... 206/455, 454, 206/232, 578, 214, 449, 555, 425, 387.1, 459.5; 220/503, 505, 256, 259, 524

[56] References Cited

U.S. PATENT DOCUMENTS

| | | | |
|---|---|---|---|
| 877,078 | 1/1908 | Havenhill et al. . | |
| 2,112,816 | 3/1938 | Rulon . | |
| 3,755,925 | 9/1973 | Court . | |
| 3,926,308 | 12/1975 | Sullivan . | |
| 4,054,206 | 10/1977 | Kobayashi et al. | 206/387.1 |
| 4,095,694 | 6/1978 | Jost . | |
| 4,545,486 | 10/1985 | Bostic . | |
| 4,596,329 | 6/1986 | Eldridge, Jr. . | |
| 4,643,301 | 2/1987 | Hehn et al. . | |
| 4,966,285 | 10/1990 | Otake et al. | 206/455 |
| 4,977,483 | 12/1990 | Perretta . | |
| 5,016,752 | 5/1991 | Haugen, Jr. . | |
| 5,044,500 | 9/1991 | Webber et al. | 206/455 |
| 5,251,745 | 10/1993 | Repp et al. . | |
| 5,263,579 | 11/1993 | Blackman | 206/455 |
| 5,301,803 | 4/1994 | Hansen et al. | 206/232 |
| 5,339,950 | 8/1994 | Li . | |
| 5,472,091 | 12/1995 | Hewitt et al. | 206/455 |

*Primary Examiner*—Paul T. Sewell
*Assistant Examiner*—Luan K. Bui
*Attorney, Agent, or Firm*—Sand & Sebolt

[57] ABSTRACT

A storage container, primarily for photographs and their negatives, is formed as a one-piece member of plastic material. A rectangular housing is formed by a base and pairs of parallel spaced sidewalls and end walls. A flat panel is pivotally mounted on the base and swings into the housing to form a first storage compartment with the base for receiving the negatives. The photographs are placed on the panel and are retained in the container by a closure lid which is pivotally mounted on one of the end walls of the housing opposite of the pivotal mounting of the panel. The lid is moved into a spaced parallel juxtaposition with the panel to a closed, latched position forming a second storage compartment between the panel and lid for storing the photographs. Printed indicia is placed on an inclined end wall of the lid to identify the contents of the container. A partition is formed on the panel to enable the second storage compartment to store two stacks of 3½×5 photographs or one stack of 4×6 photographs, or the container is molded to store only 3½×5 photographs. A stepped shoulder is formed in the base to form top and bottom shelves. The bottom shelf forms a first storage compartment with a transverse width which is approximately ½ the width of the second storage compartment.

8 Claims, 6 Drawing Sheets

PHOTOGRAPH AND NEGATIVE STORAGE CONTAINER

CROSS REFERENCE TO RELATED APPLICATION

This application is a continuation-in-part of pending application Ser. No. 08/264,964 filed on Jun. 24, 1994 now U.S. Pat. No. 5,558,225.

BACKGROUND OF THE INVENTION

1. Technical Field

The invention relates to a storage container for storing objects, and particularly for storing photographs and negatives in a compact container for ease of storage and viewing. More particularly, the invention relates to such a container which will store photographs in a first compartment and the related negatives in a second compartment.

2. Background Information

An individual when obtaining finished photographs will also receive the negatives, both of which are usually placed in an envelope. In most instances, the negatives are misplaced after the photographs have been reviewed or stored separate from the photographs making them difficult to locate in the future when additional prints are required. Very often the photographs are placed in an album and labeled to enable the observer to easily retrieve the photographs by subject matter for subsequent reviewing and showing to friends and relatives. However, the negatives are very seldom kept in the album and are usually placed in a separate drawer or other remote location, and in most instances will become lost or misplaced.

One type of container which has been developed for storing both the photographs and negatives is shown in U.S. Pat. No. 5,016,752. The container of this patent also recognizes that photographs come in various sizes for example 3½×5 and 4×6 being the most common sizes. Thus, this prior art container provides provisions for different size photographs by providing removable tabs to enable the container to accommodate both standard sizes of photographs. However, once the tabs are removed for the larger size photos, they cannot be conveniently or satisfactorily used for the smaller 3½×5 print size. Furthermore, the negatives are exposed and can become dislodged from their storage in the lid upon the repeated opening and closing of the lid.

Therefore, the need exists for an improved storage container for objects, and in particular for photograph prints and their negatives which will enable the two standard size photographs to be selectively stored in the container or which will enable only 3½×5 sized photographs to be stored in the container, as well as the negatives in a safe secured condition.

SUMMARY OF THE INVENTION

Objectives of the invention include providing an improved storage container for photographs and their negatives in a convenient, safe and secured container; and in which the negatives are maintained in a normally closed storage compartment which needs not be opened or disturbed when the container is opened and closed for viewing the photographs stored therein.

A further objective is to provide such a storage container which will accommodate both standard size photographs, for example the 3½×5 and 4×6 size selectively without requiring any particular manipulation of the container; and in which the larger size photograph of 5×7 can be stored in the negative storage compartment if desired, or which will store only 3½×5 photographs and their negatives.

Still another objective of the invention is to provide such a storage container which can be mass produced relatively inexpensive of a transparent or translucent plastic material as an integral one-piece member.

A further objective of the invention is to provide such a storage container having a sloped end wall which is adapted to contain printed information such as the subject matter covered by the photographs stored therein; and in which the sloped end wall enables a rapid viewing of the identifying indicia without opening or moving the containers from their stored positions when a plurality of such containers are placed in a drawer or storage rack; or which has a flat end wall.

Another objective is to provide such a storage container which is of a simple, rugged and inexpensive construction, yet which provides a relatively dust free storage container for various size photographs or only 3½×5 photographs, and their negatives; and in which the container can be latched and unlatched easily without excessive manipulation of the latching mechanisms.

These objectives and advantages are obtained by the improved storage container of the invention, the general nature of which may be stated as including a base formed with a stepped shoulder and having first and second spaced end walls, said stepped shoulder forming top and bottom shelves; panel means pivotally mounted on the second end wall of the base and movable into spaced juxtaposition with said base when in a closed position and extending to adjacent said stepped shoulder for forming a first storage compartment between said bottom shelf and panel means, said first storage compartment extending between said second end wall and said stepped shoulder, and said panel means and top shelf forming a generally flat continuous support surface when in the closed position; and lid means pivotally mounted on the first end wall of the base and movable into a closed position on the base and extending to adjacent said second end wall in spaced juxtaposition with the panel means when the panel means is in its closed position for forming a second storage compartment between said support surface and lid means.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
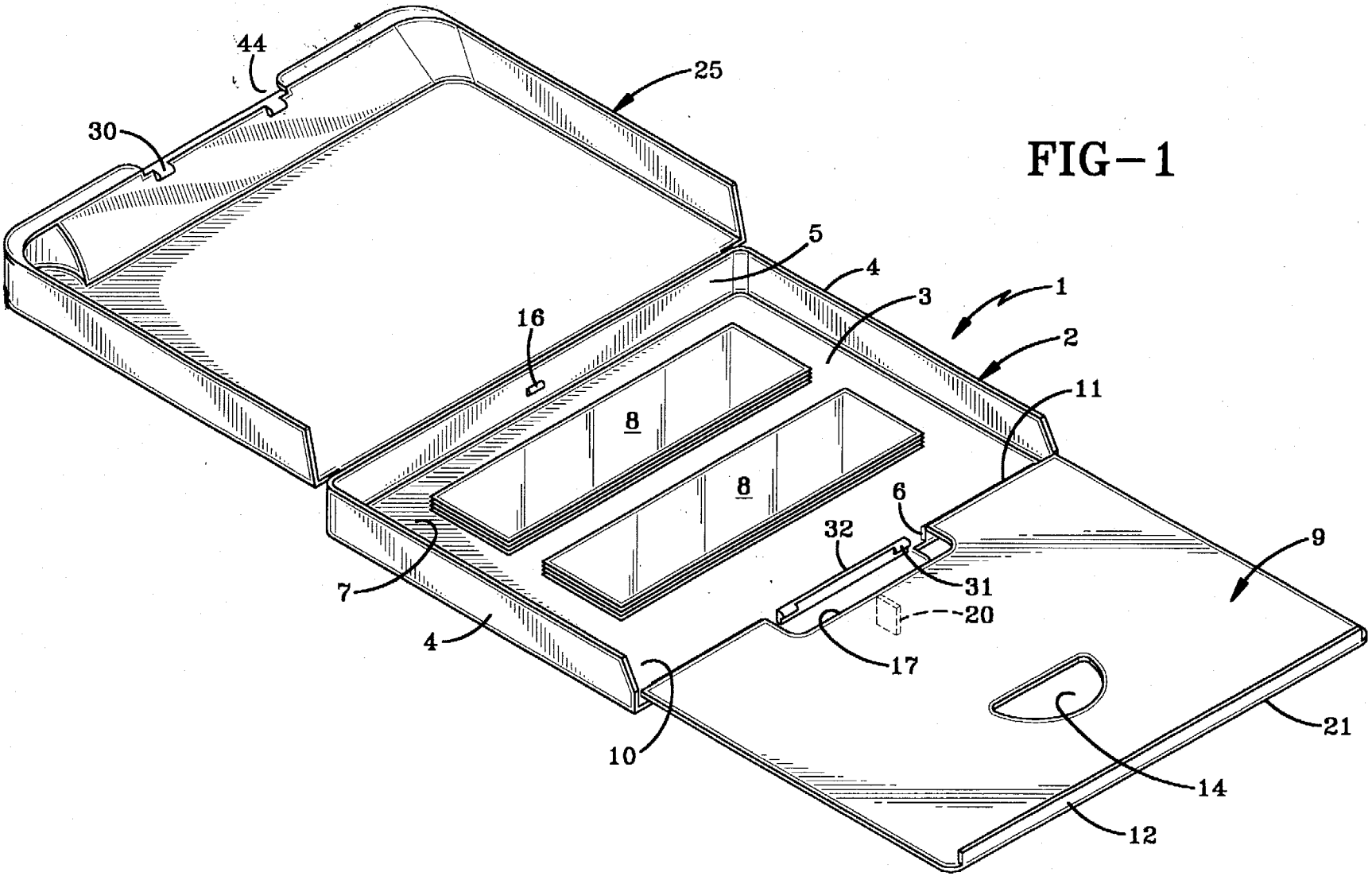
FIG. 1 is a perspective view showing the storage container in a full open position with two stacks of negatives in the negative storage compartment thereof.

The storage container of the present invention is indicated generally at 1, and preferably is formed of a one-piece plastic member which includes a box-like housing indicated generally at 2. Housing 2 is formed by a flat planar base 3 and a pair of spaced parallel sidewalls 4, generally of equal height, and spaced end walls 5 and 6. End wall 5 is the same height as sidewalls 4 with end wall 6 being approximately ⅓ the height thereof. Walls 4, 5 and 6 form a rectangular storage compartment 7 adapted to store a plurality of negatives 8 or other types of relatively flat objects.

Figure 4:
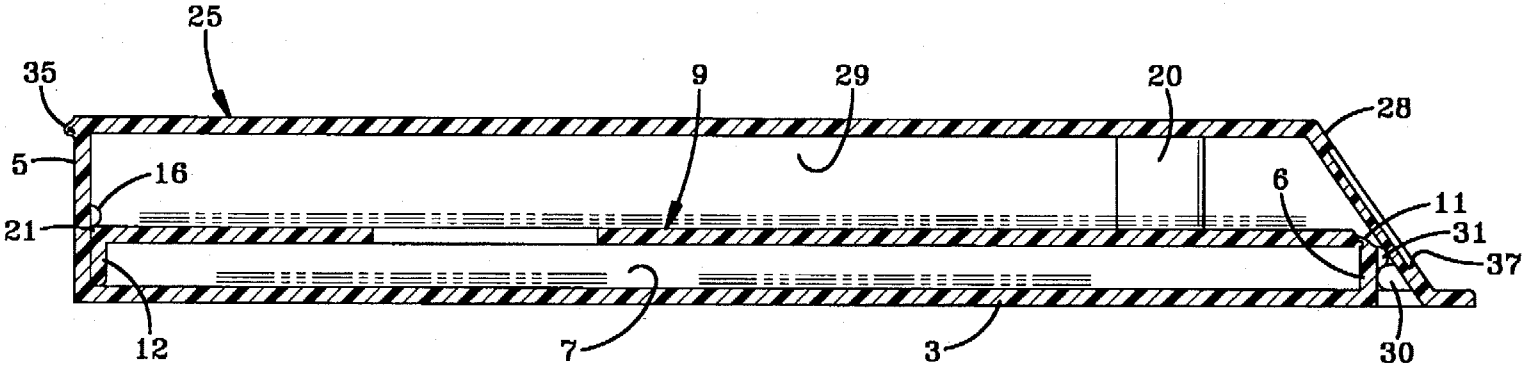
FIG. 4 is an enlarged sectional view taken on line 4—4, FIG. 3.

A flat panel indicated generally at 9, is hingedly mounted to the top of end wall 6 as shown in FIG. 4, by a living hinge 11. Panel 9 includes an end wall 12 opposite of hinge 11, which is approximately the same height as end wall 6 of housing 2. Panel 9 is sized to the general dimension of the interior of storage compartment 7 defined by walls 4, 5 and 6. A crescent-shaped opening 14 is formed in panel 9 to enable a user to grasp panel 9 and move it from the closed position of FIG. 2 to its open position of FIG. 1.

Figure 2:
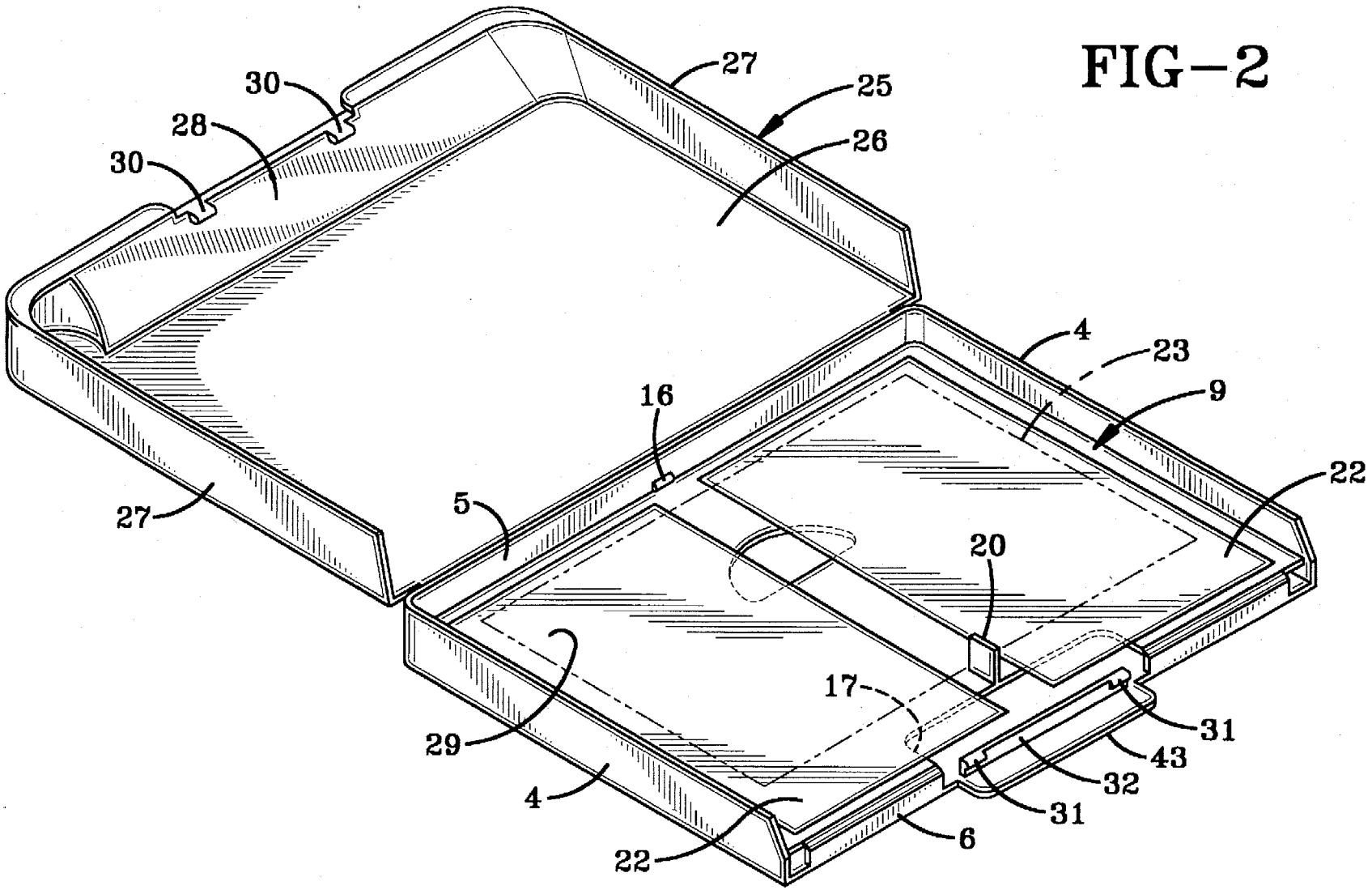
FIG. 2 is a perspective view similar to FIG. 1 with the negative storage compartment shown in a closed position and with two stacks of 3½×5 photographs being shown in full lines and with a 4×6 photograph being shown in dot-dash lines in a stored position in the photograph storage container.

A small nub 16 is formed integrally on end wall 5 and functions as a latch as shown in FIG. 2, to removably latch panel 9 in its closed position. Panel 9 is also formed with a U-shaped cutout 17 at an inner edge thereof and divides the living hinge 11 into two equal hinge sections. A small partition tab 20 is formed on the top surface of panel 9, when viewing panel 9 in its closed position of FIG. 2, adjacent U-shaped notch 17 and projects upwardly therefrom.

As shown in FIG. 1, negatives 8 are placed in storage compartment 7 and are retained therein upon the pivotal movement of panel 9 from the open position of FIG. 1 to the closed position of FIG. 2 wherein panel 9 is in a spaced juxtaposition with base 3 and parallel therewith. As indicated above, nub 16 engages, the front edge 21 formed at the junction of panel 9 and end wall 12, to form a snap-fit latching engagement therewith.

Referring to FIG. 2, partition 20 enables two stacks of 3½×5 photographs 22 to be stored on top of closed panel 9 as shown in full lines in FIG. 2, or permit the storage of a single stack of 4×6 photographs 23, which are shown in dot-dash lines in FIG. 2 in a second storage compartment 29 which is formed adjacent storage compartment 7. It is possible to store both sizes of photographs in storage compartment 29, preferably after first separating them into their respective sizes and stacks.

Figure 3:
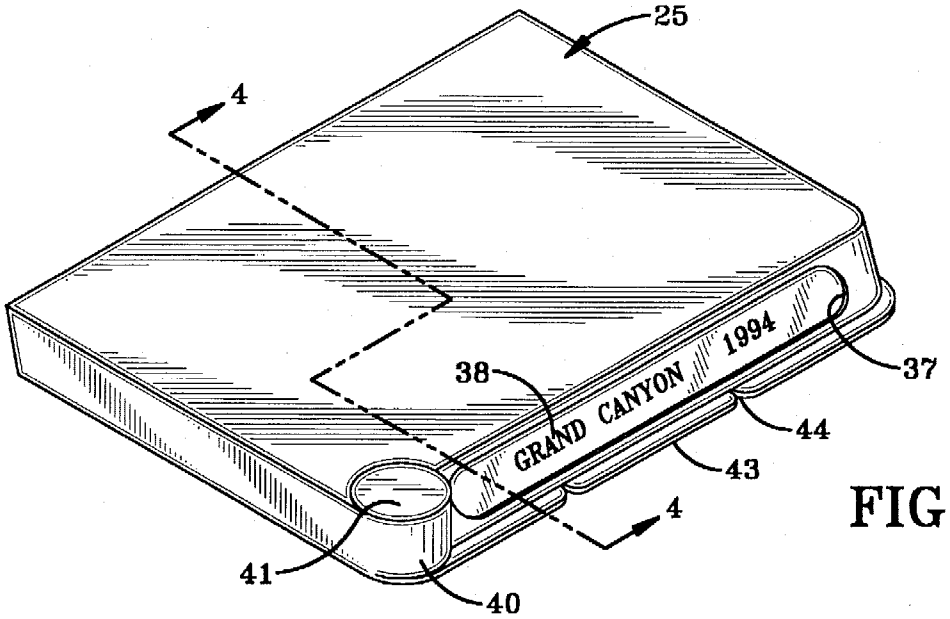
FIG. 3 is a perspective view similar to FIGS. 1 and 2, with the storage container in its full closed position.

After placement of either or both sizes of photographs in compartment 29, as shown in FIG. 2, a closure lid indicated generally at 25, is moved from its open position of FIG. 2 to its closed position of FIGS. 3 and 4. Lid 25 includes a flat planar top wall 26 and spaced parallel sidewalls 27 and an end wall 28. Lid 25 is sized so that end walls 27 when in the closed position as shown in FIGS. 3 and 4, will lie along and closely adjacent to and outside of, base sidewalls 4 to provide a generally dust free interior for housing 2. A pair of hubs 30 are formed integrally on the inside surface of end wall 28 and snap-fittingly engage a similar pair of nubs 31 which are formed on an elongated upstanding projection 32 which is formed at the end of base 3 adjacent U-shaped cutout 17 of panel 9. Nubs 31 releasably secure lid 25 in its closed position as shown in FIG. 3 and 4. Lid 25 is connected to the top of base end wall 5 by a living hinge 35 (FIG. 4), in a similar manner as is panel 9 hingedly connected to base 3.

In accordance with another feature of the invention, end wall 28 is inclined and is provided with an elongated recess 37 (FIG. 3) which may contain a label 38 having printed indicia thereon to identify the contents of the photographs stored therein. A small circular boss 40 also may be formed adjacent one corner of end wall 28 to provide a flat area 41 for containing additional printed indicia, such as a number, or possibly the manufacturers trademark.

An outwardly projecting elongated tab 43 is formed integrally with base 3 and extends outwardly from latching projection 32 and generally aligns with and lies within a cutout 44 formed in the edge of end wall 28 as shown in FIGS. 1 and 2. This configuration enables storage container 1 to be easily opened by an individual's thumb and index finger merely exerting a slight twisting motion on tab 43 and the adjacent exposed ends of base 3 which will disengage nubs 30 and 31 enabling lid 25 to be moved easily from its closed position of FIGS. 3 and 4 to the open position of FIGS. 1 and 2 on hinge 35.

In accordance with another feature of the invention, a larger size photograph, for example 5×7, could be stored within the first storage compartment 7 with negatives 8, with the 3½×5 and 4×6 sizes being stored in second storage compartment 29.

In summary, a user will either place a stack of negatives 8 or large photographs for example 5×7 (not shown) in first storage compartment 7, afterwhich panel 9 is pivotally moved to its closed position as shown in FIGS. 2 and 4 wherein panel 9 lies in spaced parallel juxtaposition with base 3 to form the first storage compartment 7 therebetween. Next, the 3½×5 or 4×6, or both sizes of photographs, are placed in second storage compartment 29 on top of closed panel 9 as shown in FIG. 2, afterwhich lid 25 is moved to its closed position as shown in FIG. 4, wherein lid 25 lies in a spaced parallel juxtaposition with panel 9 in forming second storage compartment 29. Tab 20 as indicated previously divides storage compartment 29 into two sections enabling it to hold two stacks of 3½×5 photographs.

Panel 9 merely snaps into its closed position by passing of panel edge 21 past hub 16. Likewise lid 25 also moves easily into a latched position by the snap engagement of nubs 30 and 31.

The inclined configuration of end wall 28 enables the printed indicia to be viewed easily if a plurality of storage containers 1 are stacked one on top of the other or even when placed on their edges in an upstanding abutting relationship with each other in a drawer or storage container.

As shown in FIG. 4, end wall 6 of panel 9 is sized so as to rest on base 3 when in its closed position to provide for the spaced parallel relationship of panel 9 with base 3 in forming storage compartment 7 as well as forming the bottom portion of storage compartment 29.

The use of living hinges 11 and 35 for the pivotal mounting of panel 9 and lid 25, respectively, on opposite ends of housing 2, as well as the formation of the latching nubs and partition 20, integrally with the respective components thereof of housing 2, enables container 1 to be formed as a one-piece member, preferably of a polypropylene plastic material. This construction avoids additional components that must be assembled on the container, which also are subject to breakage and loss.

A second embodiment of the storage container is shown in FIGS. 5–8, and is indicated generally at 50, and preferably is formed of a one-piece plastic member which includes a housing indicated generally at 52. Housing 52 is formed by a stepped bottom wall 53, a pair of spaced parallel sidewalls 54 and end walls 55 and 56. Stepped bottom wall 53 is formed with a stepped shoulder 64 which extends longitudinally across bottom wall 53 and forms a top shelf 60 and a bottom shelf 62. Sidewalls 54 are formed integrally with bottom wall 53 and have a generally L-shaped configuration which conforms to stepped shoulder 64 and bottom shelf 62. A pair of flanges 67 extend inwardly from sidewalls 54 and are formed integrally with the sidewalls and top shelf 60 of bottom wall 53.

An L-shaped panel 68 is hingedly mounted to the top edge of end wall 56 by a living hinge 70 and pivots between open (FIG. 5) and closed (FIG. 6) positions. Panel 68 is approximately the same size as bottom shelf 62 and includes an end wall 72 which terminates in hinge 70. A first storage compartment 69 is formed between panel 68 and bottom shelf 62 when panel 68 is in the closed position (FIG. 8) for storing a plurality of negatives 71. First storage compartment 69 has a transverse width measured between end wall 56 and stepped shoulder 64 of approximately 2⅛ inches, a longitudinal length measured between sidewalls 54 of approximately 6¾ inches and a depth measured between bottom shelf 62 and panel 68 of approximately 3/16 inches.

A flat support surface 75 is formed by panel 68 and top shelf 60 when panel 68 is in the closed position, as described further below. A crescent-shaped cut-out 74 is formed in an edge 73 of panel 68 opposite end wall 72 to enable a user to grasp panel 68 and move it from the closed position of FIG. 6 to its open position of FIG. 5. A pair of tabs 76 extend from edge 73 on each side of cut-out 74 and engage a pair of complementary-shaped nubs 78 which are formed on stepped shoulder 64 to latch shelf 68 in the closed position of FIG. 6.

Figure 7:
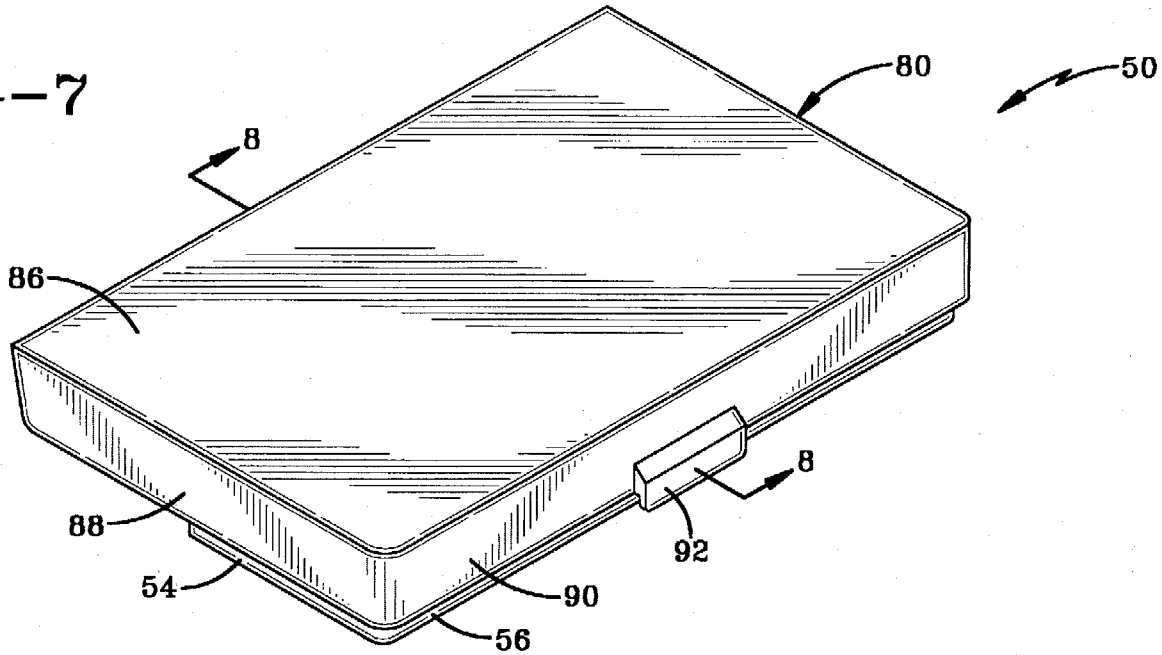
FIG. 7 is a perspective view with the storage container in its full closed position.

A lid, indicated generally at 80, is hingedly mounted on the top edge of end wall 55 by a living hinge 82. Lid 80 includes a flat rectangular-shaped top closure wall 86 along with upstanding parallel side walls 88 and an end wall 90. Walls 88 and 90 are formed integrally with top closure wall 86 and are arranged in a U-shaped configuration to enclose three sides of closure wall 86. End wall 90 includes an upwardly extending tab 92 and an inwardly extending first nub 94. First nub 94 engages a second nub 96 which extends outwardly from wall 56 of base 52 to latch container 50 in the closed position (FIG. 7).

In accordance with another feature of the invention, a second storage compartment 98 (FIG. 8) is formed between panel 68 and lid 80 when panel 68 and lid 80 are in their respective closed positions. Second storage compartment 98 has a longitudinal length measured between sidewalls 54 which is equal to the longitudinal length of first storage compartment 69, or approximately 6¾ inches, a transverse width, "A" (FIG. 8), measured between end wall 55 and end wall 72 of panel 68 which is approximately 4¼ inches and a depth measured between top shelf 60 and top closure wall 86 of approximately ⅝ inches. Inner edges of flanges 67 are spaced from one another by a distance slightly greater than 5 inches, to allow a plurality of 3½×5 photographs 100 to be stored in second storage compartment 98 (FIGS. 6 and 8).

Figure 5:
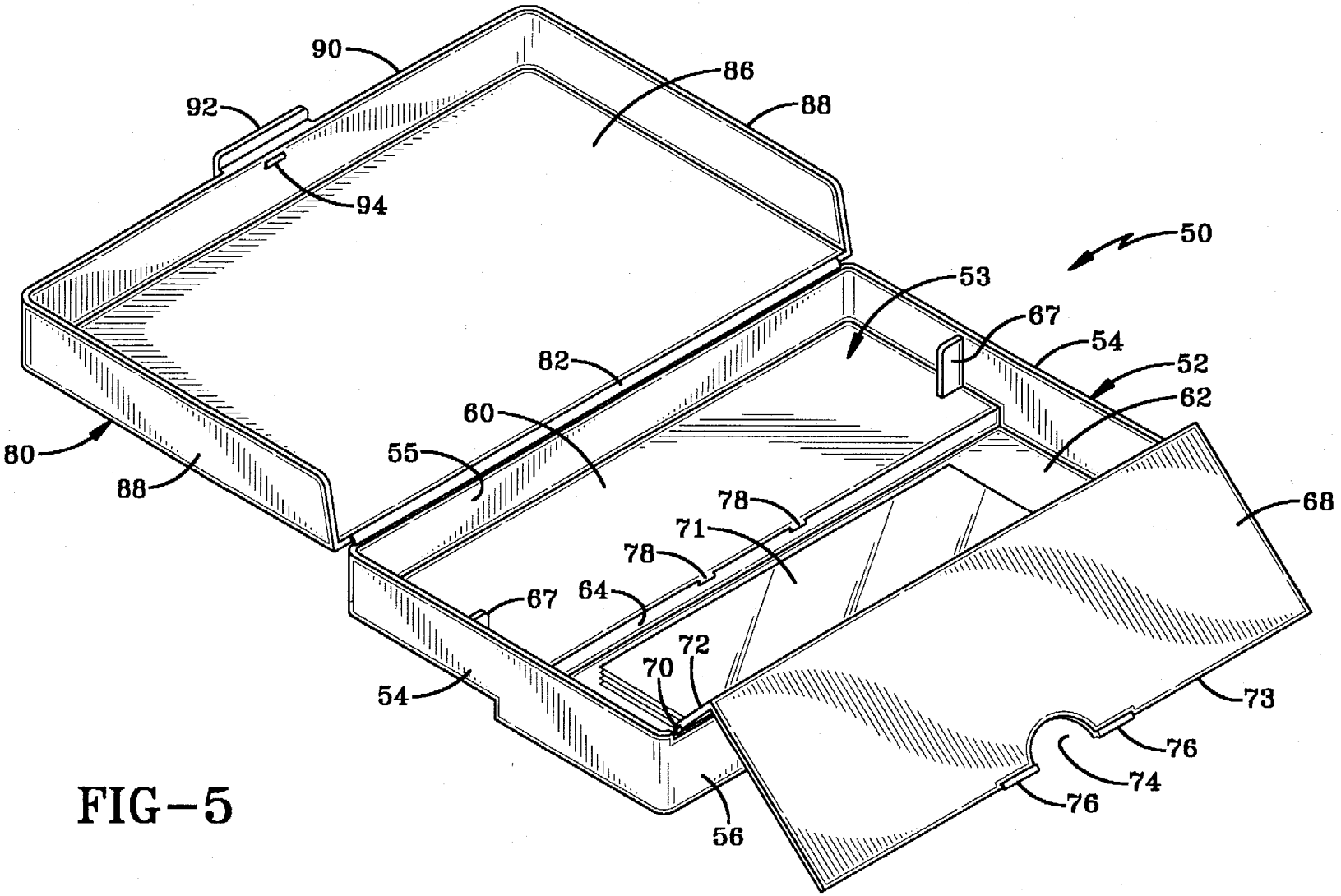
FIG. 5 is a perspective view showing a second embodiment of the storage container in a full open position with one stack of negatives in the negative storage compartment thereof.
Figure 6:
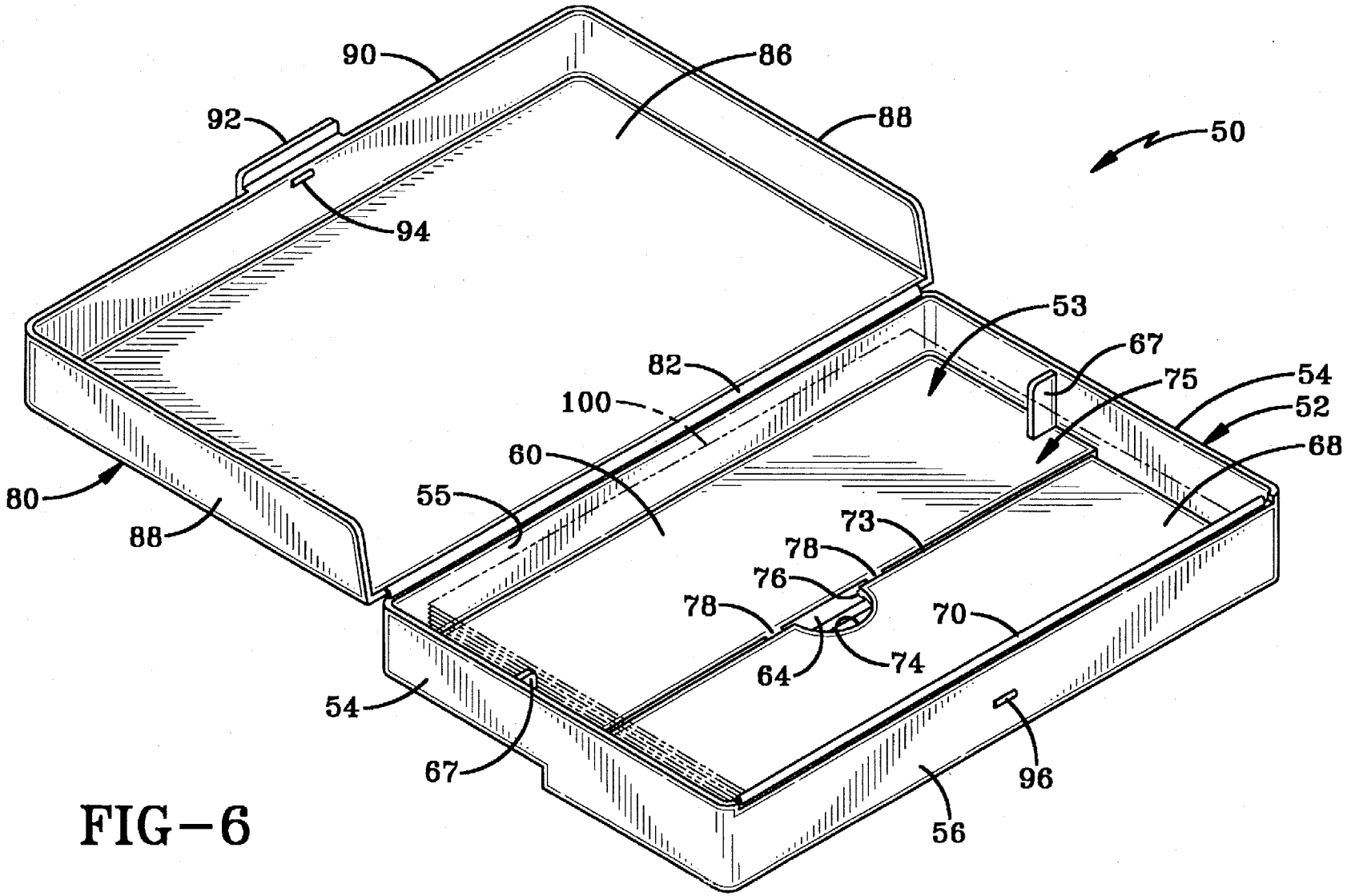
FIG. 6 is a perspective view similar to FIG. 5 with the negative storage compartment shown in a closed position and with one stack of 3½×5 photographs being shown in dot-dash lines in a stored position in the photograph storage container.
Figure 8:
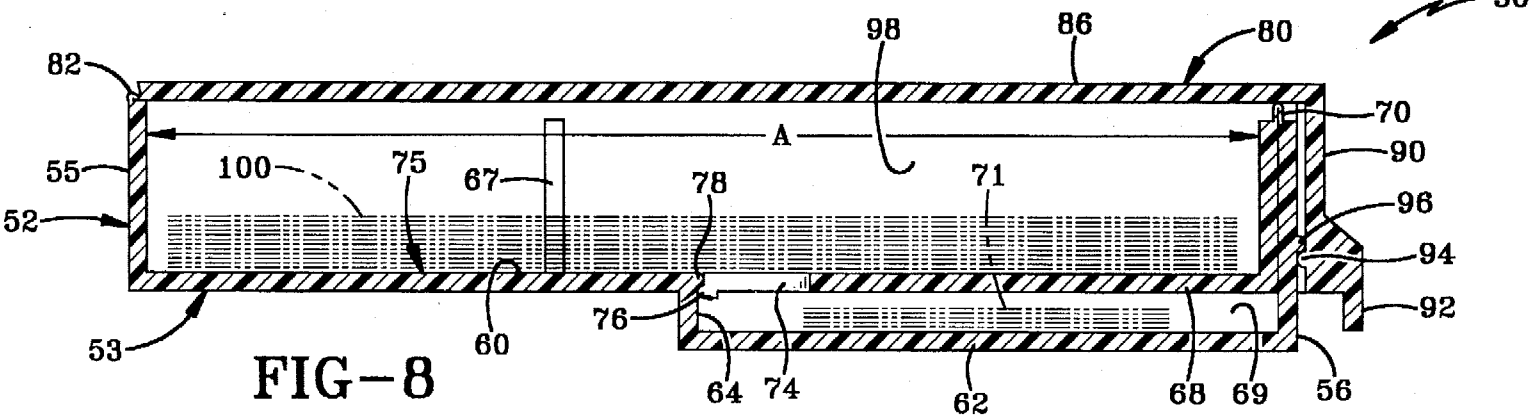
FIG. 8 is an enlarged sectional view taken along line 8—8, FIG. 7.

A user places a stack of negatives 71 on bottom shelf 62 and pivots panel 68 from the open position of FIG. 5 to the closed position of FIGS. 6 and 8. Tabs 76 latch under nubs 78 to frictionally retain panel 68 in the closed position securing negatives 71 within first storage compartment 69. End wall 72 of panel 68 abuts end wall 56 of housing 52 and panel 68 extends in a horizontal position parallel with bottom shelf 62 and aligned with top shelf 60 forming the smooth flat support surface 75.

The user places a stack of 3½×5 photographs 100 on support surface 75. Photographs 100 fit snugly between the inner ends of flanges 67 and end walls 55 and 56 preventing excessive movement of the photographs while stored in storage compartment 98. The user pivots lid 80 to the closed position (FIG. 7) and walls 88 and 90 thereof lie along and closely adjacent to and outside of housing walls 54 and 56 to provide a relatively dust free interior for housing 52. First hub 94 latches under second nub 96 (FIG. 8) to retain container 50 in the closed position and to secure photographs 100 within second storage compartment 98.

Container 50 is easily opened by applying an outward upward pressure to tab 92 wherein first hub 94 clears second hub 96 allowing lid 80 to pivot to the open position. The user removes photographs 100 from container 50 for viewing and places his or her finger within cutout 74 to unlatch and pivot panel 68 to the open position exposing negative 71 for removal from container 50.

In summary, storage container 50 is smaller in size than container 1 and is only capable of holding 3½×5 photographs and their negatives. Stepped shoulder 64 of base 53 forms first storage compartment 69 which houses negatives 71 and panel 68 pivots into housing 52 and encloses storage compartment 69 forming flat support surface 75 with top shelf 60. A stack of 3½×5 photographs fit snugly between flanges 67 and walls 55 and 72 of housing 52 and panel 68, respectively. Lid 80 lies in a spaced parallel relationship with support surface 75 in forming second storage compartment 98.

The use of living hinges 70 and 82 for the pivotal mounting of panel 68 and lid 80, respectively, on opposite ends of housing 52, as well of the formation of the latching hubs, integrally with the respective components of housing 52, enables container 50 to be formed as a one-piece member, preferably of a polypropylene plastic material.

Although the improved storage containers are intended primarily for storing photographic prints and their negatives, they conceivably could be used for storing other generally flat items in the two spaced storage compartments arranged in a stacked configuration. Likewise, the storage containers preferably are formed of a material having sufficient transparency to enable some of the contents to be visible through the walls.

Accordingly, the improved storage container is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved storage container is constructed and used, the characteristics of the construction, and the advantageous, new and useful results obtained; the new and useful structures, devices, elements, arrangements, parts and combinations, are set forth in the appended claims.

We claim:

1. In combination, a plurality of photographs, a strip of negatives and a storage container for storing said photographs and negatives, said storage container including a base with a stepped shoulder which forms top and bottom shelves, first and second spaced end walls and a pair of sidewalls; panel means pivotally mounted on the first end wall of the base for movement into spaced juxtaposition with said base when in a closed position, said panel means and top shelf forming a generally flat continuous support surface when the panel means is in the closed position; a first storage compartment for storing the negatives formed between the bottom shelf and panel means when said panel means is in the closed position; lid means pivotally mounted on the second end wall of the base for movement into a closed position on the base and extending to adjacent said first end wall in spaced juxtaposition with the panel means when the panel means is in its closed position; and a second storage compartment for storing the photographs being formed between the support surface and lid means when the lid means is in the closed position.

2. The combination defined in claim 1 in which the first and second storage compartments are substantially equal in longitudinal length measured between the sidewalls; and in which the second storage compartment has a transverse width measured between the end walls approximately twice the transverse width of the first storage compartment measured between the first end wall and the stepped shoulder.

3. The combination defined in claim 1 in which the photographs are 3½×5 print size.

4. The combination defined in claim 1 in which the storage container further includes first latching means for latching the panel means in its closed position when forming the first storage compartment, and second latching means for latching the lid mean in the closed position when forming the second storage compartment.

5. The combination defined in claim 1 in which the panel means includes a generally flat planar panel, a panel end wall and a hinge which extends between the panel end wall and the first end wall of the base to pivotally mount said panel on the base and allow said panel to move into spaced parallel juxtaposition with the bottom shelf of the base.

6. The combination defined in claim 5 in which the stepped shoulder, the first end wall and portions of the side walls define the periphery of the first storage compartment; and in which the first and second end walls and the sidewalls define the periphery of the second storage compartment.

7. The combination defined in claim 1 which the lid means includes a generally flat lid, a pair of spaced parallel sidewalls and an end wall formed on said lid; in which a hinge pivotally mounts the lid on the second end wall of the base; and in which the lid sidewalls lie adjacent to and outside of the base sidewalls when the lid means is in the closed position.

8. The combination defined in claim 1 in which the panel means and lid means are pivotally mounted on opposite end walls of the base and movable into overlapping juxtaposition with each other and with the base, whereby said first and second compartments are stacked one on the other.

* * * * *